US005564561A

United States Patent [19]

Black et al.

[11] Patent Number: 5,564,561

[45] Date of Patent: Oct. 15, 1996

[54] THERMAL INSULATOR

[75] Inventors: April M. Black, Marion County; Benton J. Pittman, Hendricks County; Karen L. Rhoades, Marion County, all of Ind.

[73] Assignee: Scicor, Inc., Indianapolis, Ind.

[21] Appl. No.: 255,531

[22] Filed: Jun. 8, 1994

[51] Int. Cl.[6] ..... B65D 25/08

[52] U.S. Cl. ..... 206/219; 206/521; 206/204; 206/591

[58] Field of Search ..... 206/521, 523, 206/524, 524.1, 204, 588, 591, 592, 593, 594, 219; 62/457.9, 372

[56] References Cited

U.S. PATENT DOCUMENTS

| | | | |
|---|---|---|---|
| 2,522,381 | 9/1950 | Kramer | 150/52 |
| 3,106,313 | 10/1963 | Kurhan | 220/97 |
| 3,885,403 | 5/1975 | Spencer | 62/530 |
| 3,990,872 | 11/1976 | Cullen | 206/204 X |
| 4,268,567 | 5/1981 | Harmony | 428/195 |
| 4,462,224 | 7/1984 | Dunshee et al. | 62/530 |
| 4,530,220 | 7/1985 | Nambu et al. | 62/457.2 X |
| 4,687,118 | 8/1987 | Clark | 240/444 |
| 4,856,651 | 8/1989 | Francis, Jr. | 206/219 |
| 4,878,482 | 11/1989 | Pfeffer | 126/375 |
| 4,925,029 | 5/1990 | Friedman et al. | 206/588 X |
| 4,958,635 | 9/1990 | Roberts | 62/530 X |
| 4,967,573 | 11/1990 | Wilhelm | 62/530 |
| 5,048,734 | 9/1991 | Long | 224/148 |
| 5,129,519 | 7/1992 | David et al. | 206/523 |
| 5,139,151 | 8/1992 | Chelak | 206/523 |
| 5,188,877 | 2/1993 | Magaro | 428/80 |
| 5,216,098 | 6/1993 | Ahmed et al. | 526/288 |

*Primary Examiner*—Paul T. Sewell
*Assistant Examiner*—Tara L. Laster
*Attorney, Agent, or Firm*—Jack Schuman

[57] ABSTRACT

Thermal insulator is formed by adding a sufficient quantity of water to a superabsorbent polymer in a flexible container to form a gel. The polymer is lightly crosslinked potassium polyacrylate. The gel-holding flexible container may then be wrapped around or otherwise positioned to envelop a vial containing a temperature-sensitive specimen. The gel-holding flexible container is an effective thermal insulator which protects the specimen from potentially harmful extremes of temperatures, and also cushions the specimen-containing vial against mechanical shock.

3 Claims, 1 Drawing Sheet

THERMAL INSULATOR

BACKGROUND OF THE INVENTION

1. Field of the Invention

This invention relates, broadly speaking, to a novel thermal insulator.

More particularly, this invention relates to a novel thermal insulator which, prior to use as such, is extremely compact and lightweight, and which is activated for use as a thermal insulator by the addition of a liquid to form a gel.

Even more specifically, this invention relates to a novel thermal insulator for protecting temperature-sensitive materials, such as specimens of various human fluids (blood, sera, urine, etc.) obtained at one site, from potentially harmful extremes of temperature during shipment of such materials to a remote analytical laboratory, which thermal insulator, prior to use as such, is extremely compact and lightweight and which is activated for use as a thermal insulator by the addition of water to form a thermally insulating cushioning gel.

2. Description of the Prior Art

It has long been known to insulate containers such as bottles, containing temperature-sensitive liquids, against extremes of temperature, by wrapping insulating means around such containers. Similar means have been provided in the past to prevent heated liquids in containers from cooling.

Prior art disclosing such insulating means to be wrapped around a container must be almost numberless. Representative prior art is seen in U.S. Pat. No. 5,188,877 (1993) to Magaro, U.S. Pat. No. 2,522,381 (1950) to Kramer, U.S. Pat. No. 4,687,118 (1987) to Clark; U.S. Pat. No. 5,048,734 (1991) to Long, U.S. Pat. No. 4,878,482 (1989) to Pfeffer, U.S. Pat. No. 3,106,313 (1963) to Kurhan, and U.S. Pat. No. 4,268,567 (1981) to Harmony.

SUMMARY OF THE INVENTION

One of the objects of this invention is to provide a novel thermal insulator which, prior to use, is extremely compact and lightweight and which is activated for use by the addition of a liquid to form a gel.

Another of the objects of this invention is to provide a novel thermal insulator for protecting temperature-sensitive materials, such as, but not limited to, specimens of human fluids (blood, sera, urine, etc.) obtained at one site, from potentially harmful extremes of temperature during shipment of such materials to a remote analytical laboratory, which thermal insulator, prior to use as such, is extremely compact and lightweight and which is activated for use by the addition of water to form a thermally insulating, cushioning gel.

Other and further objects of this invention will become apparent by reference to the accompanying specification and drawings and to the appended claims.

Briefly, we have discovered that an effective thermal insulator can be made by adding to a high capacity moisture absorbent capable of forming a gel and contained in a flexible bag sufficient water to cause the gel to form. The flexible bag containing the gel can then be wrapped around temperature-sensitive material and secured in place thereby to protect the material from extremes of temperature.

DESCRIPTION OF THE DRAWINGS

Referring now to the drawings in which like numerals represent like parts in the several views.

DESCRIPTION OF THE PREFERRED EMBODIMENT

Figure 1:
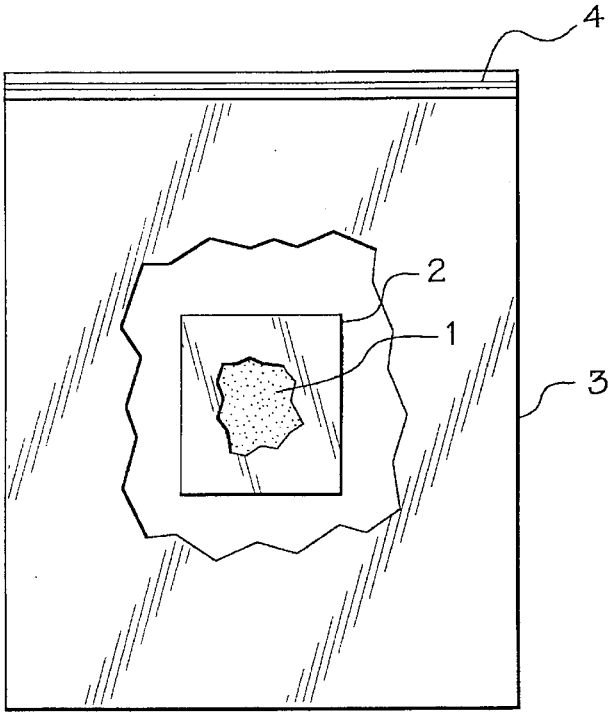
FIG. 1 shows, diagrammatically, the key elements of the thermal insulator before the addition of water, the flexible bag being partially broken away to show the pouch therein, the pouch being partially broken away to show the superabsorbent material therein.
Figure 2:
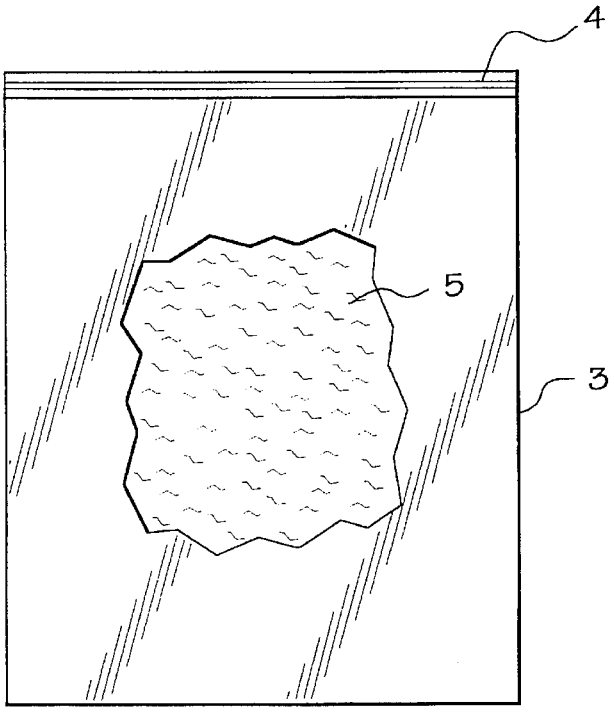
FIG. 2 shows, diagrammatically, the thermal insulator after the formation of the gel in the flexible bag by the addition of water to the superabsorbent material in the flexible bag, the flexible bag being partially broken away to show the gel therein, the pouch being omitted for the purpose of clarity.

Superabsorbent material 1, having a high liquid absorption capacity and a fast absorption rate, together with the capability of forming a gel when mixed with water, is contained in extremely compact and lightweight pouch 2.

Preferably, superabsorbent material 1 is a lightly crosslinked polyacrylate polymer, specifically a potassium polyacrylate polymer, and owes its absorbency to carboxylic groups located on the spine of the polymer. When an aqueous medium contacts this polymer, these carboxylic groups absorb rapidly and develop mutually repulsive negative charges. These charges cause the polymer to uncoil and absorb many times its weight of aqueous medium. For example, the absorption capacity of this lightly crosslinked potassium polyacrylate is the equivalent of approximately 30 grams of synthetic urine per gram of polymer. Advantageously, the absorption capacity of superabsorbent material 1 will be at least the equivalent of 30 grams of synthetic urine per gram of superabsorbent material 1. As used herein, the term "lightly crosslinked" means that the polymer is crosslinked just sufficiently to prevent the polymer from dissolving in water and not substantially more.

Pouch 2 is formed of material which readily dissolves in water or which is easily torn open. Preferably, such material is a blend of thermoplastic fibers.

A suitable pouch containing superabsorbent material 1, specifically the previously mentioned lightly crosslinked potassium polyacrylate, is readily available on the market, being manufactured by Chemdal Corporation of Palatine, Ill. and sold under their trademark LIQUI-SORB, and currently is used only to absorb and contain accidental spills and leaks in commercial and industrial packaging.

Pouch 2, filled with superabsorbent material 1, is placed in flexible bag 3.

Flexible bag 3 is of clear plastic material having along one edge a watertight seal 4 which is easily opened and closed. Preferably, flexible bag 3 may be the type of bag sold under the trademark ZIP LOCK, or may be the equivalent thereof.

The volume of flexible bag 3 must be sufficient to contain the gel 5 formed when pouch 2 is opened, by tearing or solution in water, thereby to place superabsorbent material 1 into contact with water.

One example of the volume required of flexible bag 3 is to hold the following quantities:

| | |
|---|---|
| Pouch | 4 grams of lightly crosslinked potassium polyacrylate having a absorption capacity equivalent to approximately 30 grams of synthetic urine per gram of potassium polyacrylate |
| Water | 2 Cups |

Prior to use as a thermal insulator, pouch 2 with superabsorbent material 1 and flexible bag 3, being extremely compact and lightweight, may be conveniently stored, preferably with pouch 2 inside sealed flexible bag 3 to prevent superabsorbent material 1 from prematurely absorbing ambient moisture.

To activate the thermal insulator, watertight seal 4 of flexible bag 3 is opened, pouch 2 is torn open inside flexible bag 3 to release therein superabsorbent material 1, the requisite amount of gel-forming water is introduced into flexible bag 3 and watertight seal 4 is then closed. Alternatively, watertight seal 4 of flexible bag 3 is opened, the requisite amount of gel-forming water is introduced into flexible bag 3 to dissolve pouch 2 thus releasing superabsorbent material 1 therefrom, and watertight seal 4 is then closed.

As yet another alternative, superabsorbent material 1 may be loosely held in flexible bag 3 without using the pouch 2.

In any event, after water is introduced into flexible bag 3, the said flexible bag 3 may be manually manipulated to mix the contents thereof and increase the rate of gel formation.

After formation of the gel 5 within bag 3, the said bag 3 being flexible may then be wrapped around the temperature-sensitive material to protect it from potentially harmful extremes of temperature.

When the material to be so protected is a liquid, such as a specimen of a human-derived fluid (blood, sera, urine, etc.), typically such specimen will be placed in a vial of glass or plastic, which is then sealed, and the latter in turn placed in a fluid-tight flexible bag. This fluid-tight flexible bag preferably is similar in construction to gel-holding flexible bag 3. Gel-holding flexible bag 3 will then be wrapped around the aforementioned fluid-tight flexible bag containing the sealed vial, and held in place by suitable means such as a rubber band or string or the like. Alternatively, the gel-holding flexible bag 3 may be laid in a box, the aforementioned fluid-tight flexible bag containing the sealed vial placed in the box on the gel-holding flexible bag 3 which latter can then be folded over to envelop the aforementioned fluid-tight flexible bag containing the sealed vial and the box closed, thereby maintaining the gel-holding flexible bag 3 in thermally insulating and cushioning position around the vial.

It has been found that the specimen so thermally insulated will resist freezing at −10° F. for 8 hours. It has also been found that a specimen susceptible to clot formation at elevated temperature will resist clotting at 130° F. for 6 hours.

It is clear that the gel 5 within container 3 is a very effective and novel thermal insulator. Moreover, the gel 5 within flexible bag 3 provides an effective cushion against mechanical shock which otherwise might shatter the sealed vial in transit.

In a typical application involving human-derived liquids, the laboratory which performs the analysis of specimens collected at a remote site, such as a physician's office or clinic, will mail to such physician's office or clinic a box having therein flexible bag 3 holding pouch 2 containing superabsorbent material 1, together with a flexible bag to hold a vial and an assortment of vials to hold specimens. Because of the extreme compactness and light weight of the contents of the box, shipping costs are nominal. The physician's office or clinic, after collecting a specimen on site, will introduce such specimen into a vial, will seal the vial, and will place the sealed vial in the flexible bag which is then in turn water-tightly sealed. The physician's office or clinic will then introduce the requisite amount of water into the flexible bag 3 in which the superabsorbent material 1 has been released as heretofore described so as to permit the formation of the thermally insulating and cushioning gel 5, will seal the flexible bag 3, and permit the gel to form therein. Finally, the sealed vial in its water-tight flexible bag will be enveloped in the gel-holding flexible bag 3 in the box. The box must be large enough to hold therein flexible bag 3 after the gel 5 has formed. Thereafter, the box with the specimen is preferably enclosed in a transit box, commonly known as an overshipper, which may then safely and with confidence be mailed or otherwise delivered to the laboratory.

It should be clearly understood that the present invention is not limited to protecting human derived fluids from temperature extremes but rather can be used advantageously to protect non-human-derived specimens from such temperature extremes.

Since modifications and changes which do not depart from the spirit of the invention as disclosed herein may readily occur to those skilled in the art to which this invention pertains, the appended claims should be construed as covering suitable modifications and equivalents.

We claim:

1. A shipping kit adapted to be shipped in dry light-weight condition to a first point, there to receive a quantity of temperature-sensitive material, and to protect said temperature-sensitive material from potentially harmful extremes of temperature during shipment of said temperature-sensitive material from said first point to a second point, said shipping kit comprising:

(a) a flexible bag, (b) a pouch within said flexible bag, (c) a dry superabsorbent polymer within said pouch, said superabsorbent polymer being capable of forming a thermally insulating gel when mixed with water at said first point, said superabsorbent polymer comprising a lightly cross-linked potassium polyacrylate, (d) a reversible seal on said flexible bag which can be opened or selectively water-tightly closed, (e) said pouch being openable within said flexible bag to release said superabsorbent polymer from the interior of said pouch into the interior of said flexible bag, (f) said flexible bag being adapted to receive through said reversible seal when opened a sufficient quantity of water to form a thermally insulating gel with said superabsorbent polymer, (g) whereby said shipping kit can be forwarded to said first point in dry light-weight condition prior to the introduction of water into said flexible bag, (h) whereby said reversible seal can be opened at said first point to permit the introduction of water into said flexible bag and thereafter closed, (i) whereby said pouch can be opened at said first point to release said superabsorbent polymer into said flexible bag, thereby to form a thermally insulating gel with said water, (j) whereby said temperature-sensitive material can be substantially enveloped by said gel-containing flexible bag at said first point and thereby be protected against extremes of temperature during shipment from said first point to said second point.

2. A shipping kit as in claim 1, said potassium polyacrylate having an absorption capacity equivalent to at least approximately 30 grams of synthetic urine per gram of potassium polyacrylate.

3. A shipping kit as in claim 1, said thermally insulating gel protecting said temperature-sensitive material frown mechanical shock during shipment from said first point to said second point.

* * * * *

UNITED STATES PATENT AND TRADEMARK OFFICE

CERTIFICATE OF CORRECTION

PATENT NO. : 5,564.561

DATED : October 15, 1996

INVENTOR(S) : April M. Black. Benton J. Pittman and Karen L.Rhoades

It is certified that error appears in the above-identified patent and that said Letters Patent is hereby corrected as shown below:

Column 4,

Claim 3, line 2. after "material" delete "frown" and substitute therefor --from--.

Signed and Sealed this

Seventeenth Day of December, 1996

Bruce Lehman

*Attest:*

BRUCE LEHMAN

*Attesting Officer*

*Commissioner of Patents and Trademarks*